US007303484B2

(12) United States Patent
Bieske

(10) Patent No.: US 7,303,484 B2
(45) Date of Patent: Dec. 4, 2007

(54) GOLF-PUTTER GRIP WITH REMOVABLE BALL MARK REPAIR TOOL

(76) Inventor: Brett Bieske, 4603 Shale Oaks Ave., Columbia, MO (US) 65203

( * ) Notice: Subject to any disclaimer, the term of this patent is extended or adjusted under 35 U.S.C. 154(b) by 0 days.

(21) Appl. No.: 11/393,099

(22) Filed: Mar. 30, 2006

(65) Prior Publication Data

US 2007/0049397 A1 Mar. 1, 2007

Related U.S. Application Data

(60) Provisional application No. 60/711,558, filed on Aug. 26, 2005.

(51) Int. Cl.
*A63B 57/00* (2006.01)

(52) U.S. Cl. ..... 473/286

(58) Field of Classification Search ..... 473/286, 473/408; D21/793
See application file for complete search history.

(56) References Cited

U.S. PATENT DOCUMENTS 3,763,515 A * 10/1973 Voss ..... 15/105
3,774,913 A 11/1973 Dien
4,799,684 A 1/1989 Rango
4,892,314 A 1/1990 Rango
4,925,190 A 5/1990 Learned
4,955,609 A 9/1990 Kassen
5,377,977 A * 1/1995 MacNeary ..... 473/286
5,511,785 A 4/1996 Rusin, Jr.
5,759,111 A 6/1998 Clark
6,095,935 A 8/2000 Gooselaw et al.
6,758,762 B2 7/2004 Markwood
6,964,619 B1 11/2005 Mejia
2005/0202897 A1* 9/2005 McGonigle ..... 473/285

* cited by examiner

*Primary Examiner*—Stephen Blau
(74) *Attorney, Agent, or Firm*—Hovey Wiliams LLP

(57) ABSTRACT

A golf club (10) is provided having a removable ball mark repair tool (20) seated within a recess (18) forming a part of the club grip (16). The tool (20) has outer surfaces (64,68) which mate with adjacent surfaces (26,28) of the grip (16), so that these tool surfaces (64,68) are substantially flush and are continuations of the grip outer surfaces (26,28). The tool (20) and recess (18) are cooperatively configured with interlock structure (34,36,72,74) allowing the tool (20) to firmly seat within recess (18), yet allowing the tool (20) to be readily removed for use in repairing ball marks in turf.

13 Claims, 2 Drawing Sheets

GOLF-PUTTER GRIP WITH REMOVABLE BALL MARK REPAIR TOOL

CROSS-REFERENCE TO RELATED APPLICATION

This application claims the benefit of U.S. Provisional Application No. 60/711,558, filed Aug. 26, 2005, and herein incorporated by reference.

BACKGROUND OF THE INVENTION

1. Field of the Invention

The present invention is directed to a golf club such as a putter which is equipped with a readily accessible ball mark repair tool for repairing ball marks in the turf of a golf course. More particularly, the invention is concerned with such a club wherein the ball mark repair tool is removably seated within a complemental recess formed in the club grip, and wherein the tool when seated forms an essentially flush continuation of the surface of the grip.

2. Description of the Prior Art

In the game of golf, putting greens must be as free as possible from surface irregularities. Such irregularities may be formed by balls striking the green during play or by errant swings creating ball marks, such as divots. It is the obligation of players to immediately attend to such surface irregularities, for the benefit of subsequent players and because without prompt attention the irregularities can worsen or take longer to mend. Nonetheless, golf course superintendents report that failure to repair ball marks is one of the most common breaches of course etiquette.

Small ball mark repair tools have been proposed in the past, but mainly are designed to be carried in the pocket or on the person of a player. However, as in the case of many small, loose devices, they tend to be forgotten or lost during play. Furthermore, many of these prior ball mark repair tools are of forked or bifurcated design, and can often become stuck in clothing or in a golf bag, making them difficult to retrieve.

A number of prior patents describe club-mounted repair tools. For example, U.S. Pat. Nos. 4,955,609 and 5,377,977 illustrate fixedly mounted repair tools secured to the upper end of golf club shafts, near or as a part of a club grip. These types of devices are deficient in a number of respects. First and foremost, clubs of this nature do not conform with the rules of golf, and therefore cannot be used in tournament play. Additionally, in the use of these tools, it is necessary to invert the club and attempt to repair the ball mark or divot from a standing position or by grasping the inverted club adjacent the grip with the remainder of the club extending upwardly. In either case, the effort to repair the turf becomes more difficult because of the unwieldy nature of the club-mounted tool.

U.S. Pat. Nos. 5,759,111; 4,799,684; 4,925,190; 4,892,314; and 6,758,762 all describe divot tools carried in a recess or compartment formed in a club grip. These types of club designs either alter the configuration of the normal grip or require disassembly of the grip itself. Here again, the standard rules of golf prohibit such take-apart grips.

There is accordingly a real and unresolved need in the art for an improved golf club which is equipped with a readily accessible and detachable ball mark repair tool while at the same time maintaining a normal grip contour and shape and being in full compliance with the rules of golf.

SUMMARY OF THE INVENTION

The present invention overcomes the problems outlined above and provides an improved golf club grip which conforms to the rules of golf while having a removable turf repair tool in the club grip. Broadly speaking, a golf club in accordance with the invention includes an elongated shaft with a golf head secured to one end of the shaft and having an elongated grip adjacent the other end of the shaft. The grip is preferably formed of resilient synthetic resin material and presents a circumferentially and axially extending outer surface. A tool-receiving recess is formed in the grip in communication with the grip outer surface along a portion of the axial length thereof. A ball mark repair tool is normally seated within the recess and is selectively removable therefrom. The tool presents an axially extending tool outer surface which mates with adjacent portions of the grip outer surface to present a substantially flush and coplanar continuation of the grip outer surface, when the tool is seated within said recess.

In preferred forms, the tool-receiving recess communicates with both the upper surface of the grip and extends along the grip length. The tool has a handle advantageously formed of the same synthetic resin material as the grip, with the handle having top and front surfaces which mate with the corresponding top and axial surfaces of the grip. Additionally, interlocking channel and projection structure is provided at the sidewall interfaces between the tool handle and recess, so that the tool may be firmly seated within the recess to prevent inadvertent loss thereof.

DETAILED DESCRIPTION OF THE PREFERRED EMBODIMENT

Figure 1:
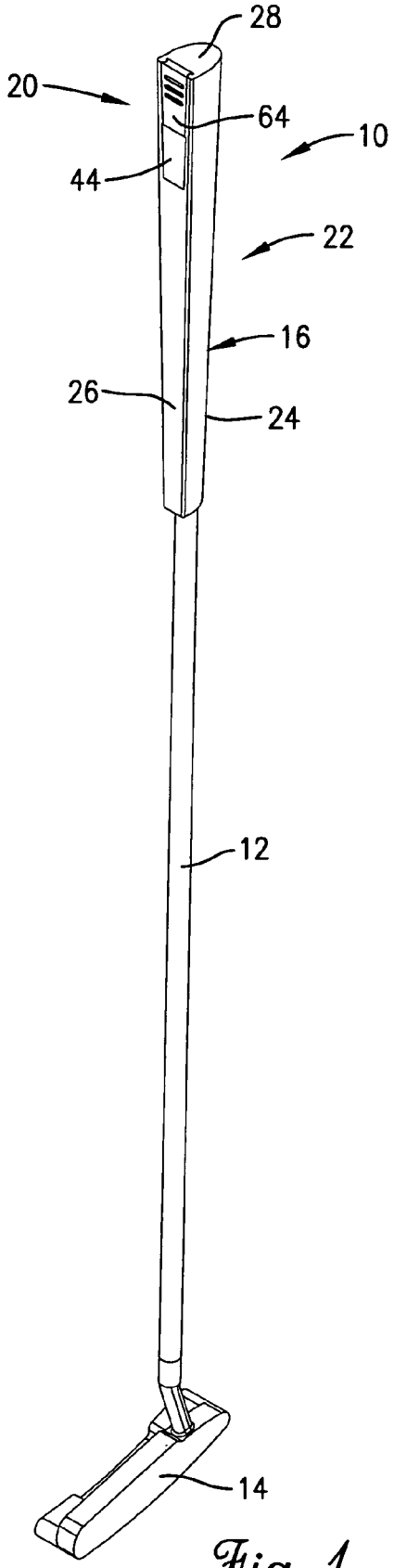
FIG. 1 is a perspective view of a golf putter in accordance with the invention, equipped with a removable ball mark repair tool.
Figure 2:
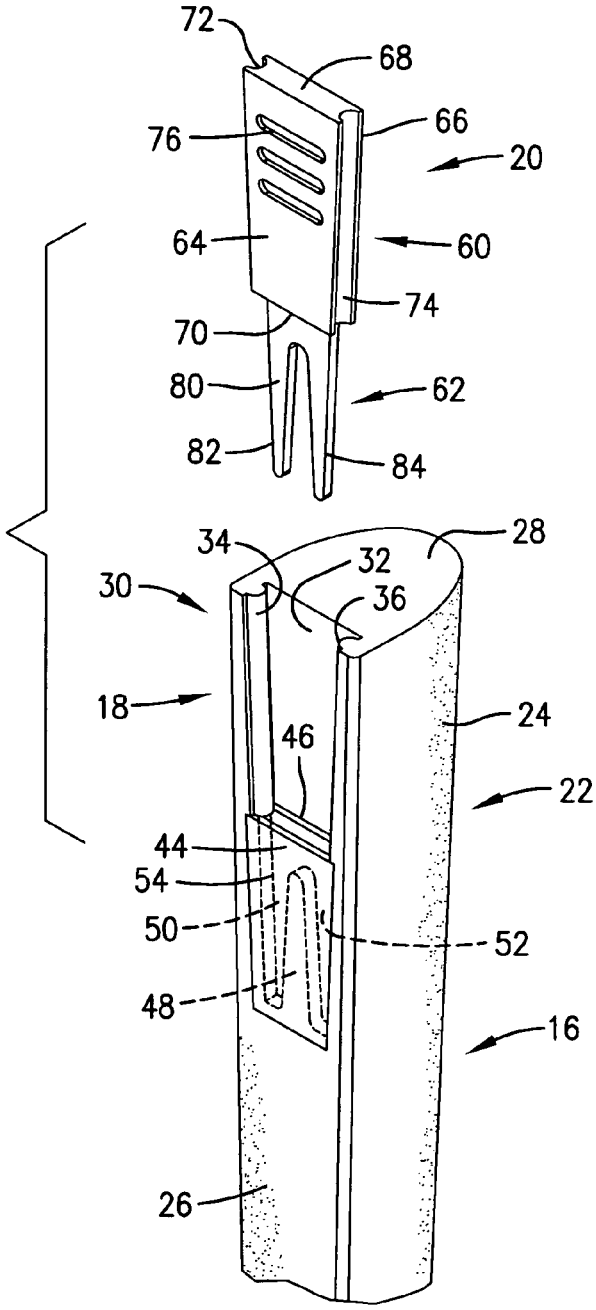
FIG. 2 is a fragmentary, exploded perspective view illustrating the grip of the putter of FIG. 1, together with the removable ball mark repair tool.

Turning now to the drawings, a golf club 10 in accordance with the invention is illustrated in FIGS. 1 and 2. The club 10 includes an elongated shaft 12 having a golf head 14 secured to the lower end thereof, and a grip 16 adjacent the opposed upper end of the shaft. The grip 16 has a recess 18 formed therein, which is configured to complementally receive a ball mark repair tool 20. The club 10 of FIG. 1 is a putter, but it will be understood that the principles of the invention can equally be applied to other types of clubs.

In more detail, the grip 16 is formed of molded elastomeric material applied to the upper end of shaft 12, and in the illustrated embodiment includes an outer surface 22 presenting a rounded section 24 and a flattened section 26. The grip 16 also has a flattened, uppermost butt surface 28. Of course, other grip designs could also be employed, such as a circular outer surface.

Figure 4:
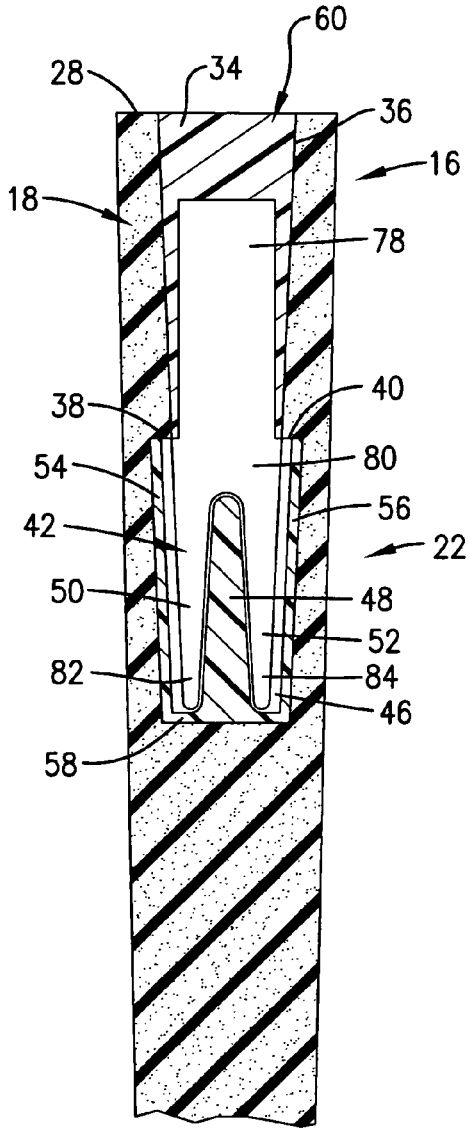
FIG. 4 is a fragmentary, front vertical sectional view of the grip and seated tool depicted in FIG. 3.

The recess 18 is formed within the grip 16 and has an integral upper section 30 defined by vertically extending back wall 32 and opposed sidewalls 34 and 36 in the form of elongated, rounded, inwardly extending projections. The lower ends of the sidewalls 34, 36 define respective shoulders 38 and 40 (see FIG. 4). The recess 18 also has a lower slotted section 42 which is separately formed and molded in place within the grip 16. The section 42 is defined by spaced apart front and rear panels 44 and 46, with an internal, upwardly extending, tapered segment 48 between the panels 44, 46. Thus, the section 42 is of bifurcated design as best illustrated in FIG. 4, presenting a pair of tine-receiving slots 50, 52 on either side of the segment 48. The lower section 42 is completed by sidewalls 54, 56 below the shoulders 38, 40, and bottom wall 58.

The tool 20 is of two-piece design, including a synthetic resin handle 60 and a bifurcated component 62 that may be formed of metal, plastic, or other suitable material. Preferably, the handle 60 is fabricated from the same material as the remainder of grip 16, and has a front surface 64, rear surface 66, flattened top surface 68, and bottom surface 70. A pair of recessed, channel-forming sidewalls 72 and 74 extend between top and bottom surfaces 68 and 70 and are operable to mate with opposed sidewalls 34 and 36 of recess 18. The front surface 64 is equipped with a series of laterally extending gripped indents 76, as best seen in FIG. 2. The component 62 has an upper section 78 which is molded into the body of handle 60, as well as a lower, bifurcated section 80 presenting legs 82 and 84.

Figure 3:
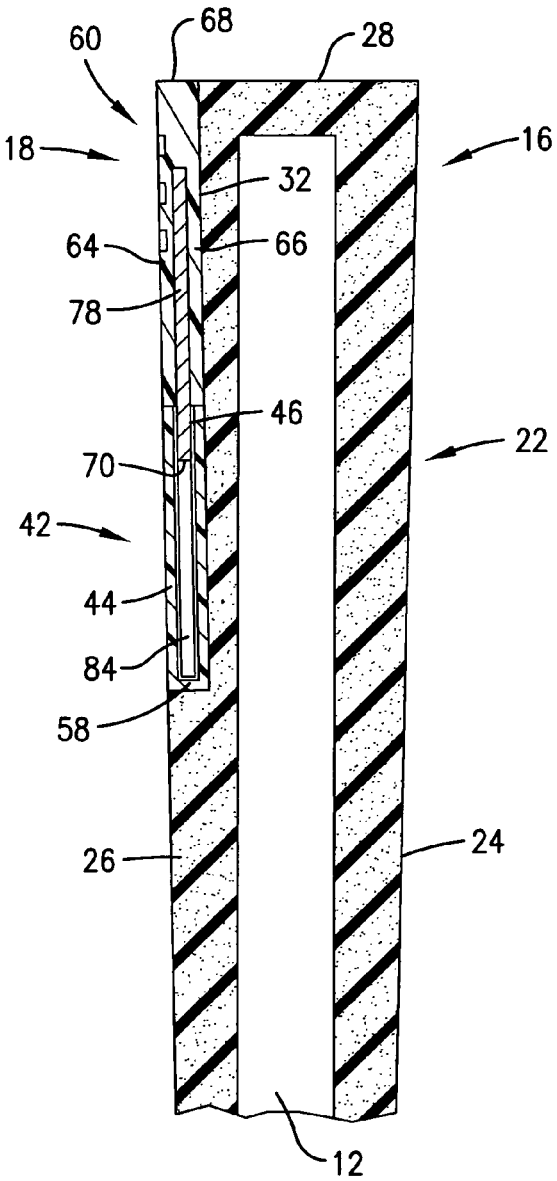
FIG. 3 is a fragmentary, side vertical sectional view illustrating the upper portion of the grip shown in FIGS. 1 and 2, with the ball mark repair tool seated within the grip recess.

In normal use, the tool 20 is fully received within recess 18 as depicted in FIGS. 1, 3, and 4. In this orientation, the outer surface 64 of handle 60 is essentially flush and coplanar with the adjacent side marginal portions of grip 16. Similarly, top surface 68 of handle 60 is essentially flush and coplanar with the top surface 28 of grip 16. In this seated condition, the legs 82 and 84 are received within slots 50 and 52 of lower section 42. As such, the tool 20, when seated within recess 18, is fully consistent with and conforms to the rules of golf. Indeed, a mock-up prototype of the present invention has been evaluated by the United States Golf Association, and that organization has determined that the invention conforms to the rules of golf.

When it is desired to use tool 20 to repair ball marks in the turf, it is only necessary to apply an upwardly extending force at the region of indents 76, so as to shift the tool 20 out of the recess 18. The tool can then be used in the well-known fashion, until it is re-seated within recess 18.

It will thus be appreciated that the specially configured tool 20 and grip recess 18 provide mating outer surfaces which are substantially flush and coplanar, effectively serving as a continuation of the grip outer surface 22, when the tool 20 is seated within the recess 18.

Although the invention has been described with reference to the preferred embodiment illustrated in the attached drawing figures, it is noted that equivalents may be employed and substitutions made herein without departing from the scope of the invention as recited in the claims. For example, the tool 20 may be securely received within the lower section 42 without need for the slotted or bifurcated design. Additionally, the tool 20 may mate or otherwise slide within the recess 18 without use of the channel-forming sidewalls 72 and 74 and opposed sidewalls 34 and 36. For example, the recess 18 may include flat sidewalls 72 and 74 (not shown) and corresponding flat opposed sidewalls 34 and 36 (not shown). The tool 20 also need not include indents 76, or the tool may include circular or other shaped dimples or detents.

I claim:

1. A golf club comprising:

an elongated shaft;

a golf head secured to one end of the shaft;

an elongated grip adjacent the other end of said shaft and presenting a circumferentially and axially extending outer surface;

a tool-receiving recess formed in said grip and in communication with said grip outer surface along a portion of the axial length thereof; and a ball mark repair tool normally seated within said recess and selectively removable therefrom, said tool presenting an axially extending tool outer surface, said tool outer surface mating with said grip outer surface to present a substantially flush continuation of the grip outer surface, when the tool is seated within said recess, said recess presenting a pair of opposed side surfaces extending inwardly from said grip outer surface, said tool having a pair of sidewalls which mate with said recess side surfaces, and said recess side surfaces and said mating tool sidewalls presenting elongated channels, while the other of said recess side surfaces or mating tool sidewalls present elongated projections received within said channels.

2. The golf club of claim 1, said grip having an upper surface, said recess communicating with said upper surface, said tool having an upper tool surface which is substantially flush with said grip upper surface to form a continuation of the grip upper surface, when the tool is seated within said recess.

3. The golf club of claim 1, said recess having a bifurcated lower section, said tool having a pair of tines received within said lower section.

4. The golf club of claim 1, said tool sidewalls having said channels, said recess side surfaces having said mating projections.

5. The golf club of claim 1, said grip presenting an arcuate surface and a flattened surface, said recess being located adjacent and in communication with said flattened surface.

6. The golf club of claim 1, said tool outer surface having a series of gripping indents.

7. The golf club of claim 1, said club being a putter.

8. A golf club grip comprising:

an outer surface;

a tool-receiving recess formed in said grip and in communication with said grip outer surface; and a ball mark repair tool normally seated within said recess and selectively removable therefrom, said tool presenting a tool outer surface, said tool outer surface mating with said grip outer surface to present a substantially flush continuation of the grip outer surface, when the tool is seated within said recess, said recess presenting a pair of opposed side surfaces extending inwardly from said grip outer surface, said tool having a pair of sidewalls which mate with said recess side surfaces, and said recess side surfaces and said mating tool sidewalls presenting elongated channels, while the other of said recess side surfaces and mating tool sidewalls present elongated projections received within said channels.

9. The golf club grip of claim 8, wherein the golf club grip is adjacent an elongated shaft of a golf club.

10. The golf club grip of claim 8, said grip having an upper surface, said recess communicating with said upper surface, said tool having an upper tool surface which is substantially flush with said grip upper surface to form a continuation of the grip upper surface, when the tool is seated within said recess.

11. The golf club grip of claim 8, said recess having a bifurcated lower section, said tool having a pair of tines received within said lower section.

12. The golf club grip of claim 8, said tool sidewalls having said channels, said recess side surfaces having said mating projections.

13. The golf club grip of claim 8, said grip presenting an arcuate surface and a flattened surface, said recess being located adjacent and in communication with said flattened surface.

* * * * *